US006369512B1

(12) United States Patent
Alig et al.

(10) Patent No.: US 6,369,512 B1
(45) Date of Patent: Apr. 9, 2002

(54) DUAL BEAM PROJECTION TUBE AND ELECTRON LENS THEREFOR

(75) Inventors: Roger Casanova Alig, Princeton Junction, NJ (US); Dennis John Bechis, Yardley, PA (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/411,110

(22) Filed: Oct. 4, 1999

Related U.S. Application Data

(60) Provisional application No. 60/103,097, filed on Oct. 5, 1998.

(51) Int. Cl.[7] ..... H01J 29/46

(52) U.S. Cl. ..... 315/15; 315/372; 315/375; 313/399; 313/409; 313/450; 313/461; 313/467; 313/469

(58) Field of Search ..... 315/15, 372, 375; 313/399, 409, 450, 461, 467, 469

(56) References Cited

U.S. PATENT DOCUMENTS

| | | | | |
|---|---|---|---|---|
| 3,873,879 A | | 3/1975 | Hughes | 315/13 C |
| 3,919,583 A | | 11/1975 | Hasker et al. | 313/448 |
| 4,317,065 A | | 2/1982 | Hughes | 313/414 |
| 4,381,473 A | | 4/1983 | Endoh et al. | 313/414 |
| 4,481,445 A | * | 11/1984 | Gorski | 315/14 |
| 4,529,910 A | | 7/1985 | Garewal et al. | 315/15 |
| 4,542,320 A | | 9/1985 | Suzuki et al. | 315/15 |
| 4,567,399 A | | 1/1986 | van Gorkum | 313/449 |
| 4,591,760 A | | 5/1986 | Kimura | 315/16 |
| 4,614,894 A | | 9/1986 | Izumida | 313/414 |
| 4,800,318 A | | 1/1989 | Naiki | 313/414 |
| 4,886,999 A | | 12/1989 | Yamane et al. | 313/414 |
| 4,899,091 A | | 2/1990 | Odenthal | 315/382 |
| 4,945,284 A | | 7/1990 | Shimoma et al. | |
| 5,061,881 A | | 10/1991 | Suzuki et al. | 315/382 |
| 5,170,101 A | | 12/1992 | Gorski et al. | 315/368.1 |
| 5,204,585 A | * | 4/1993 | Chen | 315/15 |
| 5,281,892 A | | 1/1994 | Kweon et al. | 313/414 |
| 5,281,896 A | | 1/1994 | Bae et al. | 315/15 |
| 5,488,265 A | | 1/1996 | Chen | 313/414 |
| 6,025,674 A | * | 2/2000 | Tojyou et al. | 313/414 |

OTHER PUBLICATIONS

R. Casanova Alig, "Kinescope Electron Gun Design", *RCA Review*, vol. 41, Dec. 1980, pp. 517–536.

R. Murai, et al., Projection CRT Electron Gun with High–Resistive–Layer Focus Lens, *SID 98 Digest*, Society for Information Display, 1998, pp. 429–432.

"BrightView 21" Digital Autoscan Monochrome Monitor, *AFP Imaging*, 3 pages.

Gerhard Spekowius, et al., "A new high–brightness monochrome monitor based on color CRT technology", *SPIE*, vol. 3031, 1997, pp. 651–661.

* cited by examiner

*Primary Examiner*—Don Wong
*Assistant Examiner*—Jimmy T. Vu
(74) *Attorney, Agent, or Firm*—William J. Burke

(57) ABSTRACT

A projection tube has a phosphor-coated faceplate at one end of a vacuum envelope and a plural-beam providing electron lens structure at the opposite end thereof. The electron lens structure includes four electrodes having axially-aligned apertures defining parallel channels for the plural electron beams to pass through to be focused and converged onto a small spot on the faceplate. The first and second electrodes of the electron lens structure shape the electron beams and the third and fourth electrodes thereof converge and focus the electron beams toward the same location on the faceplate. The potential applied to the fourth electrode is at or close to the potential at the phosphor, and is substantially higher than the potential applied to the third electrode. The lens structures of the third and fourth electrodes may each include an inner electron lens structure and an outer electron lens structure. The lens structure of the invention provides a projection tube having greater brightness and/or smaller spot size than is conventionally available.

32 Claims, 3 Drawing Sheets

DUAL BEAM PROJECTION TUBE AND ELECTRON LENS THEREFOR

This Application claims the benefit of U.S. Provisional Application Ser. No. 60/103,097 filed Oct. 5, 1998.

The present invention relates to a projection tube and, in particular, to an electron beam lens structure for a projection tube.

Projection displays typically employ one or more projection tubes having a faceplate or screen on which an image or a sub-image to be displayed is produced, which image is projected through an optical lens system onto a viewing surface. Conventional rear-screen projection television receivers are examples of such displays. A color projection display may have a single projection tube having on its faceplate three colors of phosphors which produce a color image that is projected onto a viewing surface for viewing, or may have three projection tubes, e.g., one each for red, green and blue sub-images, which are projected and combined at the viewing surface into a color image. Conventional projection displays suffer from an inability to produce high-brightness, high-resolution images—a trade-off of improvement of one and degradation of the other must be dealt with.

The principal reasons for such lack of brightness and resolution originate with the projection tubes that initially produce the image that is projected. High brightness requires a high electron beam current impinging on the light-producing phosphors that produce the image or sub-image. High resolution requires a small spot size for the electron beam where it impinges upon the phosphors. Unfortunately, conventional projection tubes suffer from a substantially increasing spot size at high beam currents, or, in other words, an inability to provide both high beam current and small spot size at the same time. The demands being placed on better resolution and higher brightness can not be met by conventional single-beam projection tubes.

One published approach to increasing brightness involves removing the shadow mask from a conventional television color cathode ray tube (CRT) and to replace the color phosphors with a monochrome phosphor, and to simply focus the three electron beams produced by the three electron guns thereof onto the same spot on the monochrome phosphor. While an improvement in brightness has been demonstrated by such arrangement, the fundamental trade off of increased spot size vs. brightness has not been adequately solved as is required for projection tube applications. In fact, the nature of a television CRT which strives for a large screen size with minimum CRT depth dimension imposes a requirement for wide-angle beam deflection that does not enhance the small spot size/high beam current performance. In addition, the larger diameter (e.g., 29 mm) neck of a color CRT undesirably increases the cost and weight of the CRT.

Conventional wisdom suggests that greater brightness may be attainable with larger aperture CRTs, i.e. CRTs having a larger opening in the electron lens thereof The problem with a larger electron lens opening is that the CRT also requires a larger deflection yoke which consumes additional electrical power, and so generates additional heat leading to higher operating temperature and lower reliability, all of which is not desirable. The conventional alternative of extending the length of the electron gun is also undesirable because the CRT becomes too large in depth dimension as to be practically marketable. Another conventional approach is to provide additional grids within the electron lens structure biased at potentials intermediate those of the grids closer to the cathode and the screen potential, but this has the effect of increasing the effective opening of the electron lens with the same detrimental effects as described above, and still providing only a single electron beam.

Accordingly, there is a need for a projection tube having an electron lens structure that provides an improvement in both brightness and spot size over that of single-beam projection tubes and modified three-beam television-type CRTs.

To this end, the projection tube of the present invention comprises a vacuum envelope having a faceplate, a coating of phosphor on the faceplate of the projection tube, an anode electrode on the faceplate and adapted for receiving an anode potential, and an electron lens structure positioned opposite the faceplate of the projection tube for projecting a plurality N of beams of electrons toward the faceplate of the projection tube. According to a further aspect of the invention, the electron lens structure comprises a cathode including a number N of electron sources, wherein N is a positive integer greater than unity, a first electrode having N apertures therethrough axially aligned with the N electron sources for controllably passing N beams of electrons from the N electron sources toward said faceplate, a second electrode having N apertures therethrough axially aligned with the N apertures of the first electrode, each of larger diameter than and of longer axial dimension than the apertures of the first electrode, for passing the N beams of electrons from the first electrode toward and focusing the N beams of electrons substantially coincident on one spot on the faceplate, and a third electrode having N apertures therethrough axially aligned with the N apertures of the second electrode, each of larger diameter than and of longer axial dimension than the apertures of the first electrode, for passing the N beams of electrons from the second electrode to the spot on the faceplate, wherein the third electrode is adapted to be biased at a potential closer to the potential of the anode electrode with respect to the cathode potential than is the second electrode.

BRIEF DESCRIPTION OF THE DRAWING

The detailed description of the preferred embodiments of the present invention will be more easily and better understood when read in conjunction with the FIGURES of the Drawing which include.

DESCRIPTION OF THE PREFERRED EMBODIMENT

Figure 1:
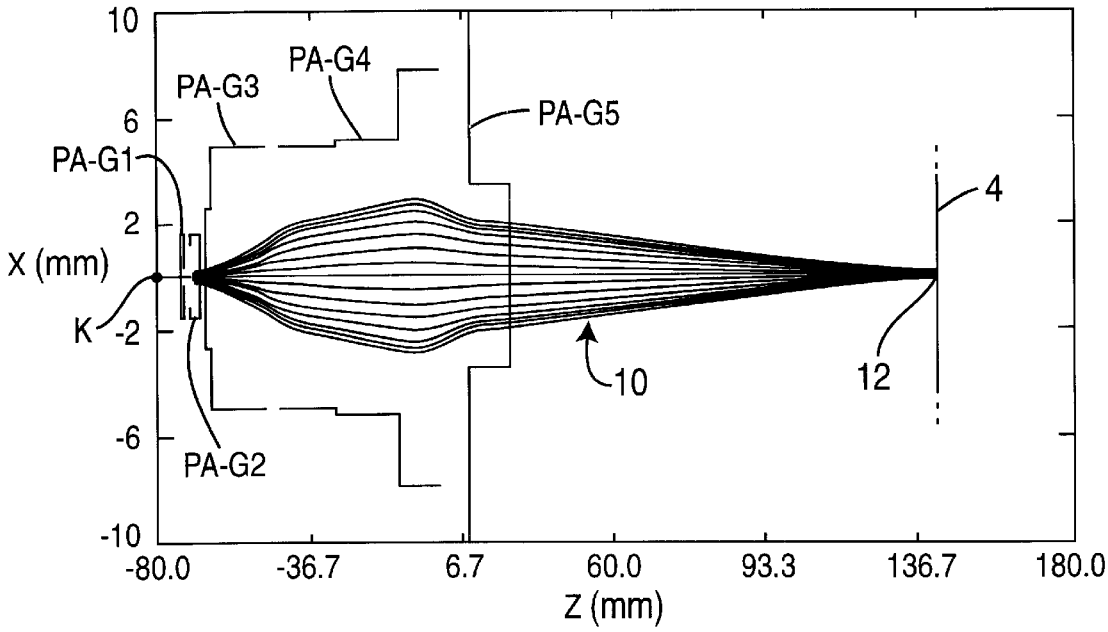
FIG. 1 PRIOR ART
FIG. 1 is spatial trajectory diagram for a prior art one-beam projection tube.

FIG. 1 is spatial electron trajectory diagram for an exemplary prior art single-beam projection tube in which the scales of the ordinate axis and of the abscissa axis differ and in which the scale along the ordinate axis is non-linear. The diagram is cylindrically symmetrical about the X=0 axis, and grids PA-G1, PA-G2, PA-G3, PA-G4 and PA-G5 are represented in cross-section. In this tube the electron lens is made as large as the diameter of the neck of the tube envelope will allow to maximize the trade-off between the desire for small spot size and high brightness produced at high beam current. A single electron gun is coaxial with the X axis, X=0. Cathode K, and first two grids PA-G1, PA-G2 that form the electron beam are located between Z=−70 mm and Z=−50 mm on the Z axis. Electron beam 10 diverges within the PA-G3 grid aperture which ends in a cylinder of 10 mm diameter and is biased at a potential of +3 1.5 kV (kilovolts) with respect to cathode K potential, and is focused by the lenses formed by the PA-G3, PA-G4 and PA-G5 grids to provide a spot 12 on the screen 14 which is located at Z=+140 mm and is biased at a potential of +31.5 kV. Grid PA-G4 extends from Z=−48 mm and Z=0 mm, and ends in a cylinder of 16 mm diameter, and is biased at a potential of +8.5 kV. Grid PA-G5 extends to Z=9 mm, has a cylinder of more than 20 mm diameter that surrounds the PA-G4 grid, and is biased at a potential of +31.5 kV.

As the beam current of electron beam 10 is increased, the repulsion between electrons in beam 10 increases due to the greater number of electrons and so the diameter of beam 10 increases, thereby producing slightly differing effects of the various lenses PA-G3, PA-G4, PA-G5 to increase the size of spot 12 on screen 14.

In addition, the amount of current that a particular electron gun can provide, and therefore, the brightness that can be obtained, is directly related to and limited by the diameter of the electron gun. Thus, to increase brightness, a larger diameter electron gun aperture is necessary to provide greater beam current, and this greater diameter aperture directly increases the size of the spot produced.

On the other hand, according to the present invention smaller and brighter spots are obtained by employing two or more electron beams produced by electron guns and electron beam lenses located within the neck of a projection tube. The guns are displaced oppositely relative to the central axis of the projection tube neck and the electron beam lenses are arranged to direct the beams to be coincident on the screen or faceplate of the projection tube.

The smaller diameter, plural-beam electron lens structures according to the present invention advantageously facilitate the obtaining of improved brightness and smaller spot size (diameter) in a projection tube. In addition, because the diameter of each electron gun decreases more rapidly than the total diameter of the set of plural electron guns increases as the number of beams is increased, the plural electron guns can be located in a much smaller diameter tube neck than can a single-gun arrangement. These advantages over a conventional single-gun projection tube may be realized in several ways, such as by providing the same brightness with a smaller spot size, or greater brightness at the same spot size, or the same brightness in a tube of lesser neck diameter and smaller electron lens size.

Figure 2:
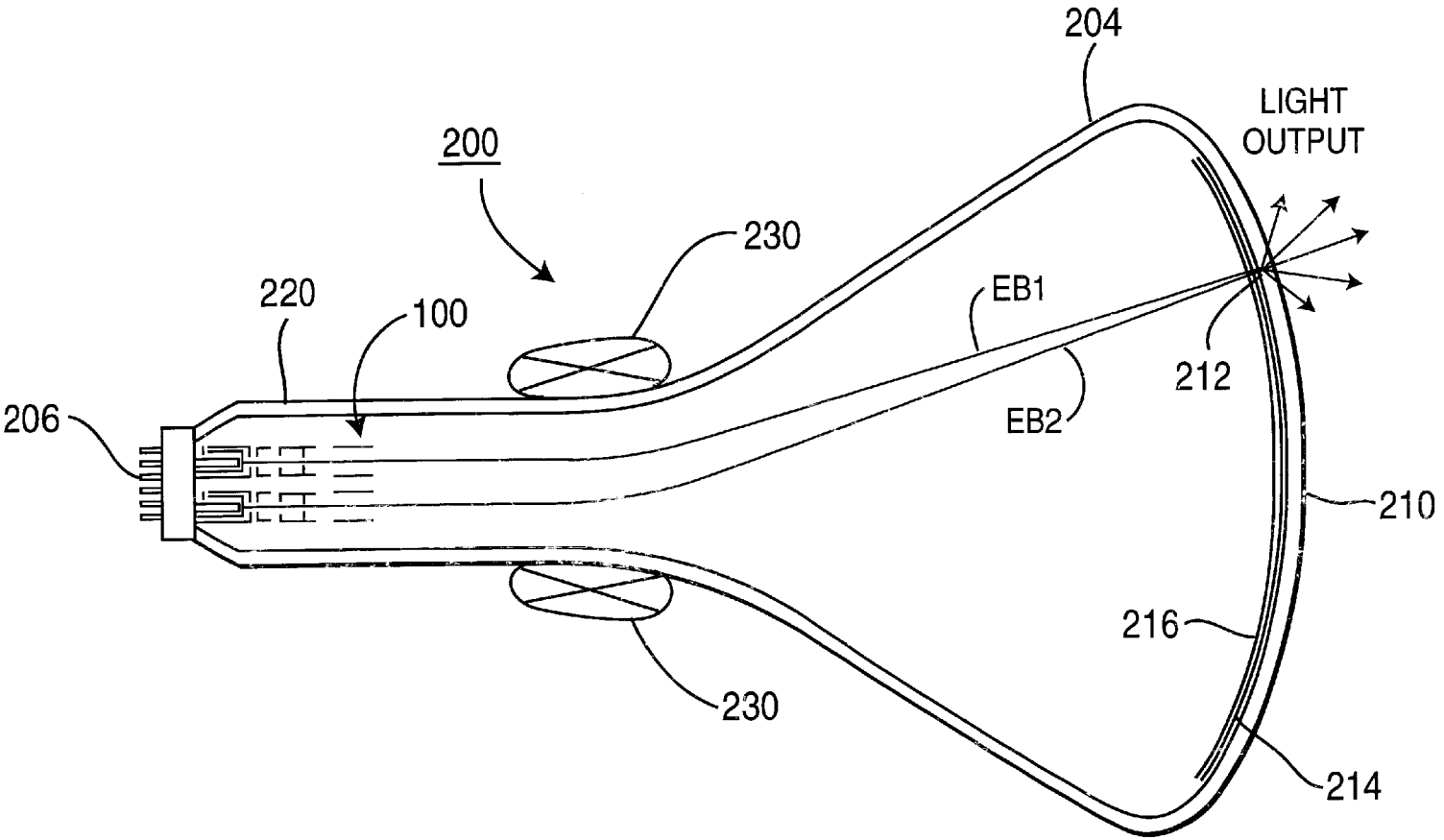
FIG. 2 is a side cross-sectional diagram of an exemplary projection tube including an electron beam lens structure in accordance with the present invention.

FIG. 2 is a side cross-sectional diagram of an exemplary projection tube 200 including an electron beam lens structure in accordance with the present invention. Projection tube 200 includes a vacuum envelope 204 that has a faceplate 210 at one end thereof and a neck 220 at the other end thereof Projection tubes differ from conventional television CRTs in that they are not intended for direct viewing, and further in that television CRTs have a larger faceplate dimension, both absolutely and relative to depth, a larger neck diameter, and a multi-color phosphor pattern rather than a monochrome phosphor coating. Thus, the deflection angle of a color CRT is large, typically about 110 degrees, as compared to a much smaller deflection angle of a projection tube, typically about 70 degrees.

Vacuum envelope 204 may be made of glass or of metal with a glass faceplate 210. The surface of faceplate 210 interior to vacuum envelope 204 is coated with a phosphor material 214 that produces light in response to electrons impinging thereon, which electrons are attracted by the potential applied to a coating 216 of conductive material (i.e. an anode electrode 216) thereon, thereby producing a spot 212 of light. Within neck 220, which may be a narrow-diameter neck as is employed with monochrome tubes rather than a larger-diameter neck as is required for a three-gun color tube, is located a plural beam, e.g., dual-beam, electron source and electron lens structure 100, to which electrical connections are made via conductive pins 206 penetrating the end wall of neck 220 of vacuum envelope 204. As a result of the narrow deflection angle of about 70 degrees, deflection yoke 230 may be a self-converging type yoke that consumes a modest level of power.

Figure 3:
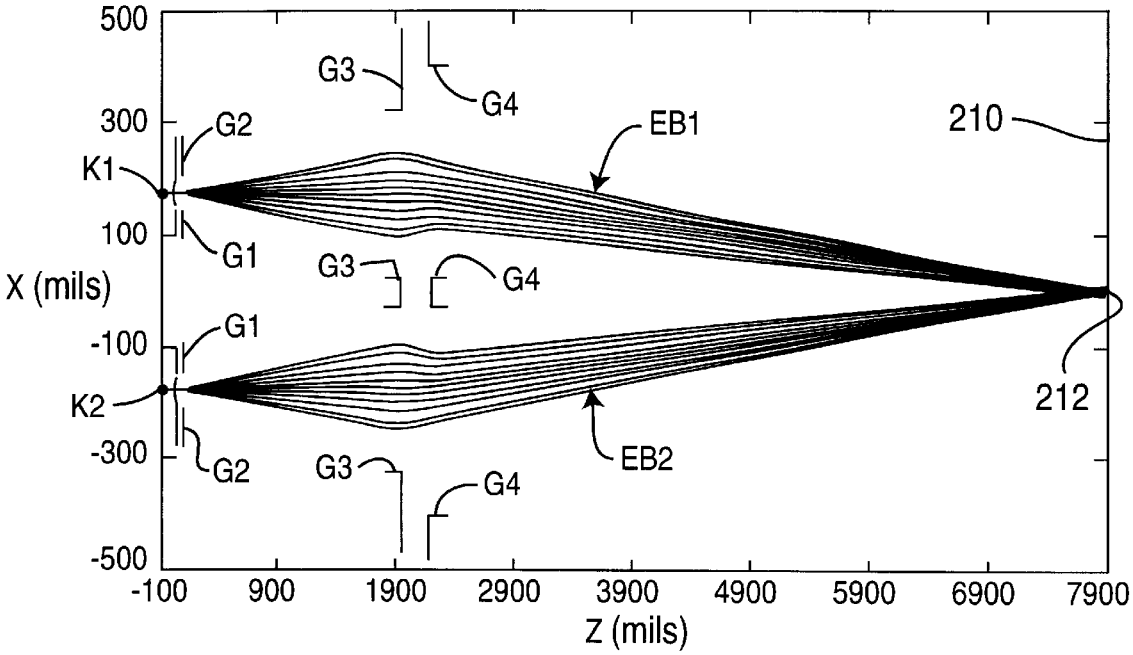
FIG. 3 is spatial electron beam trajectory diagram for the exemplary two-beam projection tube of the sort shown in FIG. 2.

FIG. 3 is spatial electron trajectory diagram for the exemplary two-beam projection tube 200 shown in FIG. 2. In FIG. 3, the scales of the ordinate axis and of the abscissa axis differ. The diagram is symmetrical about the X=0 axis, and has mirror symmetry in the X-Y and X-Z planes. Grids G1, G2, G3, and G4 are represented in cross-section. Two electron beams EB1, EB2 are produced at the two cathodes K1 and K2, which include electron guns, each having a diameter of 7.5 mm, thereby providing smaller spot size. Initial electrode structures G1, G2 are located between −2.54 mm (−100 mils) and 0 mm (0 mils) along the Z-axis of electron lens structure 100, i.e. the central longitudinal axis in the direction between cathodes K and faceplate 210 of projection tube 200. The electron beams EB1, EB2 each diverge under the influence of the G3 electrode which is biased at a potential of 8.65 kV and are each focused in spot 212 on faceplate 210 by the lens formed by electrodes G3 and G4. The G3 electrode ends in two oppositely offset apertures of 7.5 mm diameter spaced equally away from the X=0 axis and located at Z=+49.8 mm (+1960 mils). The G4 electrode structure begins at Z=+56.1 mm (+2210 mils), has two oppositely offset apertures of 9.5 mm diameter spaced equally away from the X=0 axis and located at Z=+56.6 mm (+2228 mils), and is biased at a potential of 31.5 kV. Faceplate 210 is located at Z=+2000 mm (+7900 mils) and is biased at a potential of +31.5 kV.

It is noted that the potential applied to the fourth electrode is at or close to the potential at the phosphor, and is substantially higher than the potential applied to the third electrode.

Because the electron lens structure 100 of the present invention bypasses the significant limitations brought about due to a finite cathode electron source area and space-charge induced electron beam broadening (the effects of which are greater at higher beam current levels and at smaller beam diameter), the intensity of spot 212 on faceplate 210 can be more than two times what is obtainable with a single beam-source and with a smaller spot size than is attainable with a single-beam source. Specifically, the spot 212 on faceplate 210 is produced by the addition of two or more separate electron beams EB1, EB2 each providing a pro rata portion of the total required electron beam current, and so having a lower beam current and therefore, less space-charge induced broadening. Each electron beam EB1, EB2 is preferably individually tailored for minimum spot size so that the superposition of the spots on faceplate 210 produces an aggregate spot that is about equal to, or only slightly larger than, the spot size produced by each individual beam, but with a significantly greater total beam current producing significantly greater brightness.

Spot size is predicted by the general electron-optics relation:

$$D_s = C/D_b + C_a D_b^3$$

where: $D_s$ is the spot size at the faceplate,

C is a beam quality factor, $D_b$ is the beam diameter in the main electron lens, and $C_a$ is an aberration coefficient relating to distortion of beam focus within the lens.

When optimized for the best value of beam diameter $D_b$, the spot size $D_s$ is proportional to the value $C^{3/4}\ C_a^{1/4}$. By further substituting the approximations that the beam quality factor C is approximately equal to the beam current I, i.e. C~I, and that the aberration coefficient $C_a$ is approximately equal to the inverse of the electron lens aperture area, i.e. $C_a \sim D_L^{-2}$, the equation for spot size reduces to:

$$Ds \sim I^{3/4} D_L^{-1/2}$$

where $D_L$ is the diameter of the electron lens aperture providing an electron lens area of $(\pi/4)\ D_L^2$. Thus, by replacing a single electron gun of given lens diameter providing a given current with two electron beam lens structures each of one half the given lens diameter and producing one half the given current, the resulting superimposed spot produced by the two electron beam structure is about 16% smaller than the original spot size produced by the single gun structure. Representative performance of a conventional single-gun beam and of exemplary plural-beam electron lens structures, each operating with a cathode temperature of kT=0.100 electron-volts (eV) are set forth in the table below:

| No. of Beams | G1 aperture (mils) | G1 thickness (mils) | Beam Current (mA) | Emittance (mils✓volts) | Beam Divergence Angle (>5%) | Current Density (ma/cm$^2$) |
|---|---|---|---|---|---|---|
| 1 | 25.00 | 5.00 | 1.000 | 2.91 | 1.99 | 2.66 |
| | 25.00 | 5.00 | 3.00 | 4.76 | 2.93 | 4.43 |
| 2 | 17.5 | 3.5 | 0.500 | 1.74 | 2.09 | 3.81 |
| | 17.5 | 3.5 | 1.500 | 2.62 | 2.84 | 6.42 |
| 4 | 12.50 | 2.50 | 0.250 | 1.01 | 2.62 | 4.89 |
| | 12.50 | 2.50 | 0.75 | 1.54 | 3.49 | 8.27 |
| 16 | 6.25 | 1.25 | 0.063 | 0.43 | 1.92 | 9.11 |
| | 6.25 | 1.25 | 0.190 | 0.59 | 3.05 | 12.92 |
| 4 | 17.90 | 3.58 | 0.250 | 1.40 | 1.61 | 2.61 |
| | 17.90 | 3.58 | 0.750 | 2.02 | 2.29 | 4.42 |

For the 2-guns examples, the electron guns are arranged side-by-side, and in the 4-gun and 16-gun examples, the electron guns are arranged in a 2×2 square array and in a 4×4 square array, respectively. Emittance is a measure of the electron beam quality, beam divergence angle is the conical angle defined by the locus of points for which the beam current density is 5% of the peak current density of the electron beam, and current density is the peak density of the beam current at the center of the cathode.

Thus, a two-beam electron lens structure produces the same current as the single-gun structure, but with a much higher current density at the spot because the spot size (diameter) is much smaller, as is indicated by the lower emittance values and the smaller beam divergence angle. As a result, for example, two 5.6 mm diameter electron guns produce improved spot size over a 16 mm diameter, 29 mm long, single gun. Similarly, a four-beam electron lens structure produces the same current as the single-gun structure, but with a much higher current density at the spot because the spot size (diameter) is much smaller, as is indicated by the lower emittance values and the smaller beam divergence angle. Stated in another way, the four-beam lens structure of the last example is designed to provide about the same current densities from the cathode as does the single-gun example, but has a substantially smaller divergence angle indicating a substantially smaller spot size.

In addition, because the beam quality is affected by the structure of the cathode and surrounding region, improved beam quality is obtainable with the present invention due to the reduction of spacing dimensions of the electron lens structure which contribute to a more homogeneous and uniform electron distribution within each beam and a greater degree of parallelism of the trajectories of the of the electrons within each of the plural beams. In addition, increased brightness is obtained without requiring a larger diameter electron gun aperture as in prior art devices, which prior art greater diameter aperture directly increases the size of the spot produced.

Thus, in accordance with the present invention, an electron lens coincidently focuses a plurality of electron beams that are adjusted for minimum spot size to provide a single spot of smaller size and larger total current, i.e. greater brightness, at the projection tube faceplate than is achievable with a conventional single-gun.

Figure 4:
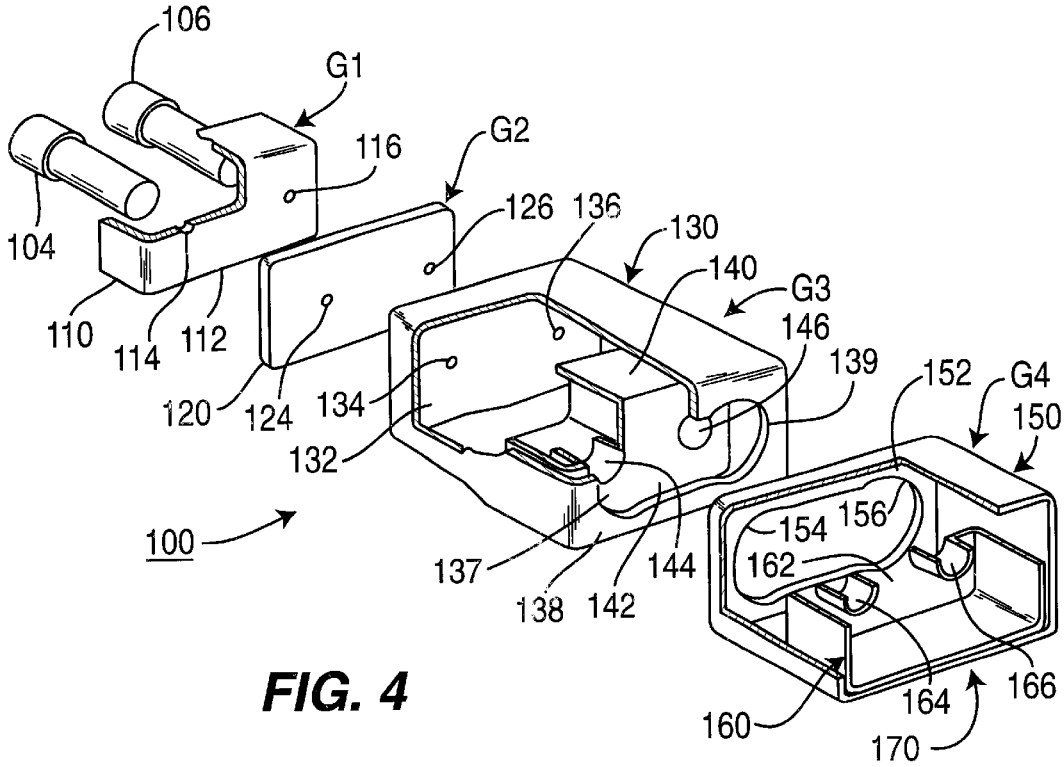
FIG. 4 is a partially cut away isometric diagram of a preferred embodiment of an electron beam lens structure according to the present invention of the sort employed in the projection tube of FIG. 2.

FIG. 4 is a partially cut away isometric diagram of a preferred embodiment of an electron beam lens structure 100 according to the present invention producing electron beams having trajectories of the sort shown in FIG. 3. Lens structure 100 generates two beams of electrons originating at electron guns 104 and 106 which are at cathode K potential, passing through electrode structures G1, G2, G3, and G4, and exiting electron lens structure 100 at lens aperture 170. Initial electrode structures G1, G2 are located between −100 mils (−2.54 mm) and 0 mils (0 mm) along the Z-axis of electron lens structure 100, i.e. the central longitudinal axis in the direction between cathodes K and faceplate 190 of projection tube 200. G3 electrode structure 130 is located between 10 mils (0.254 mm) and 2000 mils (50.8 mm) along the Z axis and G4 electrode structure 150 is located between 2250 mils (57.1 mm) and 2500 mils (62 mm) along the Z axis.

G1 electrode structure 110 has a front face 112 in which are two apertures axially aligned with electron guns 104, 106 for passing the respective electron beams EB1, EB2 emitted thereby. The two beams EB1, EB2 of electrons passing through apertures 114, 116 of the G1 structure 110 then pass through apertures 124, 126, respectively, in G2 electrode structure 120, exiting as diverging beams EB1, EB2 of electrons. The G3 electrode structure includes an outer structure 130 and an inner structure 140 to have the G3 electrode potential electrostatically converge the diverging beams EB1, EB2 of electrons from electrode G2. The two beams of electrons EB1, EB2 from electrode G2 enter the outer structure 130 of electrode G3 through relatively smaller apertures 134, 136, respectively, in the rear face 132 thereof, and proceed into the central region of inner structure 140. These beams of electrons are deflected by the electrostatic forces caused by the G3 potential to be converging and exit the central region of inner structure 140 through intermediate-diameter axially-extended apertures 144, 146, respectively, in the front face 142 thereof, and then exit outer structure 130 through the relatively larger apertures 137, 139 of the "dog-bone" shaped opening in front face 138 thereof. Finally, the two beams EB1, EB2 of electrons enter outer structure 150 of electrode G4 through relatively larger apertures 154, 156 of the "dog-bone" shaped opening in the rear face 152 thereof, which apertures 154, 156 are comparable in diameter to apertures 137, 139 of G3 outer structure 130, and then pass through intermediate-diameter, axially extended apertures 164, 166 in the front face 162 of inner structure 160 of electrode G4 and exit through lens aperture 170 having been electrostatically deflected into respective slightly converging beams EB1, EB2 that are properly focused to produce a small spot 212 on faceplate 210. All of the apertures that each electron beam EB1, EB2 passes through in electron lens 100 (e.g., apertures 114, 124, 134, 144, 137, 154, 164) are axially aligned to define the channel through which such electron beams pass.

Figure 5:
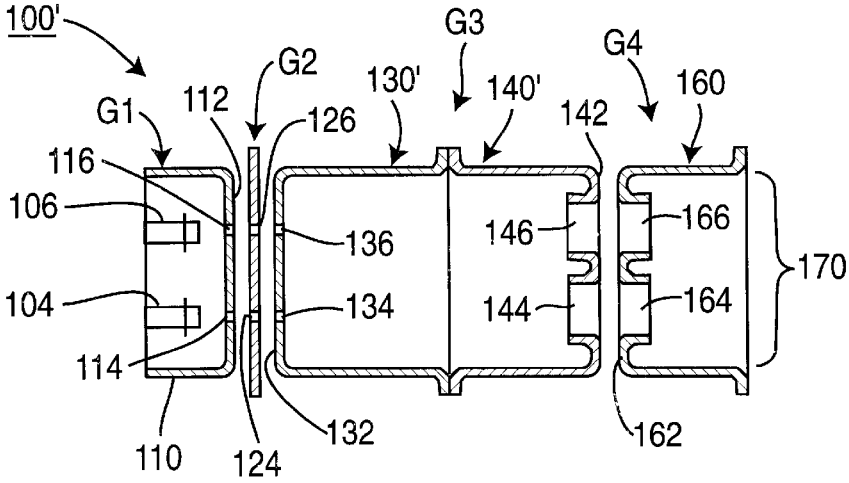
FIG. 5 is a side cross-sectional diagram of an alternative embodiment of an electron beam lens structure according to the present invention of the sort employed in the projection tube of FIG. 2.

FIG. 5 is a cross-sectional diagram of an alternative embodiment of an electron beam lens structure 100' according to the present invention also producing the electron beam EB1, EB2 trajectories of the sort shown in FIG. 3. Electron beam lens structure 100' is similar to electron beam lens structure 100 and like elements of each are designated by the same numerical designations. Structure 100' differs from lens structure 100 regarding the G3 and G4 electrodes which are simplified. Two beams of electrons from electrode G2 enter the combined rearward structure 130' and forward structure 140' of electrode G3 through relatively small apertures 134, 136, respectively, in the rear face 132 of rearward structure 130' thereof, and proceed into the central region of combined structure 130'–140'. These beams of electrons are deflected to be converging by the electrostatic forces caused by the G3 potential and exit the central region of structure 140' through intermediate-diameter axially-extended apertures 144,146, respectively, in the front face 142 thereof Finally, the two beams of electrons enter structure 160 of electrode G4 through intermediate-diameter, axially extended apertures 164, 166 in the front face 162 thereof and exit through lens aperture 170 being electrostatically deflected into a slightly converging beams EB1, EB2 that are properly focused to produce a small spot 212 on faceplate 210 of projection tube 200.

The G1, G2, G3 and G4 electrodes are typically referred to as the control grid, screen grid, focus grid and anode grid, respectively. The potential applied to the G1 grid is varied to control the flow of electrons therethrough, thereby controlling the beam current, to control the brightness of the spot 212 produced by phosphor 212 on faceplate 210 of projection tube 200. Screen grid G2 screens or shields control grid G1 and focus grid G3 from the effect of the potential applied to the other one thereof, i.e. screen electrode G2 is adapted to be biased at a potential to provide an electrostatic shield between the G1 and G3 electrodes. The potential applied to focus grid G3 is selected to converge and focus the electron beams EB1, EB2 to produce a small spot 212, and is typically about ⅓ of the potential applied to anode electrode 214. If the axial length of focus grid G3 is increased, then the fraction of the anode potential that is applied to grid G3 also is increased. The anode potential that is applied to anode 214 and to anode grid G4 is preferably high, such as between 25 kV and 35 kV, but is limited to avoid emission of X-rays and/or browning of the faceplate materials.

While the present invention has been described in terms of the foregoing exemplary embodiments, variations within the scope and spirit of the present invention as defined by the claims following will be apparent to those skilled in the art. For example, the two-beam arrangements shown in FIGS. 4 and 5 could be replaced by three-beam, four-beam or greater number plural-beam arrangements of electron guns and electron lens structures. Further, where larger apertures are utilized, such as apertures 137, 139 in front face 138 of the G3 electrode structure and apertures 154, 156 in the rear face 158 of the G4 electrode structure, such apertures may be circular apertures or may be joined by a slot to have a "dog-bone" shape as illustrated.

What is claimed is:

1. A projection tube comprising:

a vacuum envelope having a faceplate;

a coating of phosphor on the faceplate of said projection tube;

an anode electrode on the faceplate and adapted for receiving an anode potential;

an electron lens structure positioned opposite the faceplate of said projection tube for projecting a plurality N of beams of electrons toward the faceplate of said projection tube, said electron lens structure comprising:

a cathode including a number N of electron sources, wherein N is a positive integer greater than unity;

a first electrode having N apertures therethrough axially aligned with said N electron sources for controllably passing N beams of electrons from said N electron sources toward said faceplate;

a second electrode having N apertures therethrough axially aligned with said N apertures of said first electrode, each of larger diameter than and of longer axial dimension than the apertures of said first electrode, for passing the N beams of electrons from the first electrode toward and focusing the N beams of electrons substantially coincident on one spot on said faceplate; and a third electrode having N apertures therethrough axially aligned with said N apertures of said second electrode, each of larger diameter than and of longer axial dimension than the apertures of said first electrode, for passing the N beams of electrons from the second electrode to the spot on the faceplate;

wherein said third electrode is adapted to be biased at a potential closer to the potential of said anode electrode with respect to the cathode potential than is said second electrode.

2. The projection tube of claim 1 wherein said second electrode structure comprises an inner electrode structure and an outer electrode structure, said outer electrode structure having N apertures therethrough axially aligned with said N apertures of said first electrode, each aperture of larger diameter than the apertures of said first electrode, said inner electrode structure having N apertures therethrough axially aligned with said N apertures of said first electrode, each aperture of said inner electrode structure of larger diameter than and of longer axial dimension than the apertures of said first electrode, for said passing the N beams of electrons from the first electrode toward and focusing the N beams of electrons substantially coincident on said faceplate.

3. The projection tube of claim 2 wherein the N apertures of said inner electrode structure are closer to said first electrode than are the apertures of said outer electrode structure.

4. The projection tube of claim 3 wherein the N apertures of said inner electrode structure are smaller than are the apertures of said outer electrode structure.

5. The projection tube of claim 2 wherein the N apertures of said outer electrode structure are closer to said first electrode than are the apertures of said inner electrode structure.

6. The projection tube of claim 3 wherein the N apertures of said outer electrode structure are smaller than are the apertures of said inner electrode structure.

7. The projection tube of claim 1 wherein said third electrode comprises an inner electrode structure and an outer electrode structure, said outer electrode structure having N apertures therethrough axially aligned with said N apertures of said first electrode, each aperture of larger diameter than the apertures of said first electrode, said inner electrode structure having N apertures therethrough axially aligned with said N apertures of said first electrode, each aperture of said inner electrode structure of larger diameter than and of longer axial dimension than the apertures of said first electrode, for said passing the N beams of electrons from the second electrode toward the spot on said faceplate.

8. The projection tube of claim 7 wherein the N apertures of said outer electrode structure are closer to said first electrode than are the apertures of said inner electrode structure.

9. The projection tube of claim 8 wherein the N apertures of said outer electrode structure are larger than are the apertures of said inner electrode structure.

10. The projection tube of claim 1 wherein said electron lens structure further comprises a screen electrode interposed between said first and second electrodes and having N apertures therethrough axially aligned with said N electron sources, said screen electrode is adapted to be biased at a potential to provide an electrostatic shield between said first and second electrodes.

11. A two-beam projection tube comprising:

a vacuum envelope having a faceplate;

a coating of phosphor on the faceplate of said projection tube;

an anode electrode on the faceplate and adapted for receiving an anode potential;

an electron lens structure positioned opposite the faceplate of said projection tube for projecting two beams of electrons toward the faceplate of said projection tube, said electron lens structure comprising:

a cathode including two closely-spaced electron sources side by-side;

a first electrode having two apertures therethrough axially aligned with said two electron sources for controllably passing two beams of electrons from said two electron sources toward said faceplate;

a second electrode having two apertures therethrough axially aligned with said two apertures of said first electrode, each of larger diameter than and of longer axial dimension than the apertures of said first electrode, for passing the two beams of electrons from the first electrode toward and focusing the two beams of electrons substantially coincident on one spot on said faceplate; and a third electrode having two apertures therethrough axially aligned with said two apertures of said second electrode, each of larger diameter than and of longer axial dimension than the apertures of said first electrode, for passing the two beams of electrons from the second electrode to the spot on the faceplate;

wherein said third electrode is adapted to be biased at a potential closer to the potential of said anode electrode with respect to the cathode potential than is said second electrode.

12. The projection tube of claim 11 wherein said second electrode structure comprises an inner electrode structure and an outer electrode structure, said outer electrode structure having two apertures therethrough axially aligned with said two apertures of said first electrode, each aperture of larger diameter than the apertures of said first electrode, said inner electrode structure having two apertures therethrough axially aligned with said two apertures of said first electrode, each aperture of said inner electrode structure of larger diameter than and of longer axial dimension than the apertures of said first electrode, for said passing the two beams of electrons from the first electrode toward and focusing the two beams of electrons substantially coincident on said faceplate.

13. The projection tube of claim 12 wherein the two apertures of said inner electrode structure are closer to said first electrode than are the apertures of said outer electrode structure.

14. The projection tube of claim 13 wherein the two apertures of said inner electrode structure are smaller than are the apertures of said outer electrode structure.

15. The projection tube of claim 12 wherein the two apertures of said outer electrode structure are closer to said first electrode than are the apertures of said inner electrode structure.

16. The projection tube of claim 13 wherein the two apertures of said outer electrode structure are smaller than are the apertures of said inner electrode structure.

17. The projection tube of claim 11 wherein said third electrode comprises an inner electrode structure and an outer electrode structure, said outer electrode structure having two apertures therethrough axially aligned with said two apertures of said first electrode, each aperture of larger diameter than the apertures of said first electrode, said inner electrode structure having two apertures therethrough axially aligned with said two apertures of said first electrode, each aperture of said inner electrode structure of larger diameter than and of longer axial dimension than the apertures of said first electrode, for said passing the two beams of electrons from the second electrode toward the spot on said faceplate.

18. The projection tube of claim 17 wherein the two apertures of said outer electrode structure are closer to said first electrode than are the apertures of said inner electrode structure.

19. The projection tube of claim 18 wherein the two apertures of said outer electrode structure are larger than are the apertures of said inner electrode structure.

20. The projection tube of claim 11 wherein said electron lens structure further comprises a screen electrode interposed between said first and second electrodes and having two apertures therethrough axially aligned with said two electron sources, said screen electrode is adapted to be biased at a potential to provide an electrostatic shield between said first and second electrodes.

21. An electron lens structure adapted for projecting a plurality N of beams of electrons from a lens aperture toward a faceplate of a projection tube, said electron lens structure comprising:

a cathode including a number N of electron sources, wherein N is a positive integer greater than unity;

a first electrode having N apertures therethrough axially aligned with said N electron sources for controllably passing N beams of electrons from said N electron sources toward the lens aperture;

a second electrode structure including an inner electrode structure and an outer electrode structure, said outer electrode structure having N apertures therethrough axially aligned with said N apertures of said first electrode, each aperture of larger diameter than the apertures of said first electrode, said inner electrode structure having N apertures therethrough axially aligned with said N apertures of said first electrode, each aperture of said inner electrode structure of larger diameter than and of longer axial dimension than the apertures of said first electrode, for passing the N beams of electrons from the first electrode toward the lens aperture and focusing the N beams of electrons; and a third electrode having N apertures therethrough axially aligned with said N apertures of said second electrode, each of larger diameter than and of longer axial dimension than the apertures of said first electrode, for passing the N beams of electrons from the second electrode to the lens aperture;

wherein said third electrode is adapted to be biased at a higher potential with respect to the cathode potential than is said second electrode.

22. The electron lens structure of claim 21 wherein the N apertures of said inner electrode structure are closer to said first electrode than are the apertures of said outer electrode structure.

23. The electron lens structure of claim 22 wherein the N apertures of said inner electrode structure are smaller than are the apertures of said outer electrode structure.

24. The electron lens structure of claim 21 wherein the N apertures of said outer electrode structure are closer to said first electrode than are the apertures of said inner electrode structure.

25. The electron lens structure of claim 24 wherein the N apertures of said outer electrode structure are smaller than are the apertures of said inner electrode structure.

26. The electron lens structure of claim 21 further comprising a screen electrode interposed between said first and second electrodes and having N apertures therethrough axially aligned with said N electron sources, said screen electrode is adapted to be biased at a potential to provide an electrostatic shield between said first and second electrodes.

27. An electron lens structure adapted for projecting a plurality N of beams of electrons from a lens aperture toward a faceplate of a projection tube, said electron lens structure comprising:

a cathode including a number N of electron sources, wherein N is a positive integer greater than unity;

a first electrode having N apertures therethrough axially aligned with said N electron sources for controllably passing N beams of electrons from said N electron sources toward the lens aperture;

a second electrode having N apertures therethrough axially aligned with said N apertures of said first electrode, each of larger diameter than and of longer axial dimension than the apertures of said first electrode, for passing the N beams of electrons from the first electrode toward the lens aperture and focusing the N beams of electrons; and a third electrode comprising an inner electrode structure and an outer electrode structure, said outer electrode structure having N apertures therethrough axially aligned with said N apertures of said first electrode, each aperture of larger diameter than the apertures of said first electrode, said inner electrode structure having N apertures therethrough axially aligned with said N apertures of said first electrode, each aperture of said inner electrode structure of larger diameter than and of longer axial dimension than the apertures of said first electrode, for passing the N beams of electrons from the second electrode to the lens aperture;

wherein said third electrode is adapted to be biased at a higher potential with respect to the cathode potential than is said second electrode.

28. The electron lens structure of claim 27 wherein the N apertures of said outer electrode structure are closer to said first electrode than are the apertures of said inner electrode structure.

29. The electron lens structure of claim 28 wherein the N apertures of said outer electrode structure are larger than are the apertures of said inner electrode structure.

30. The electron lens structure of claim 27 further comprising a screen electrode interposed between said first and second electrodes and having N apertures therethrough axially aligned with said N electron sources, said screen electrode is adapted to be biased at a potential to provide an electrostatic shield between said first and second electrodes.

31. A two-beam monochrome projection tube comprising:

a projection tube vacuum envelope having a neck and a faceplate;

a coating of phosphor on the faceplate of said projection tube vacuum envelope for producing a monochrome image;

an anode electrode on the faceplate of said projection tube vacuum envelope and adapted for receiving an anode potential;

an electron gun and lens structure positioned in the neck of said projection tube vacuum envelope opposite the faceplate thereof for projecting two beams of electrons toward the faceplate of said projection tube, said electron gun and lens structure comprising:

a cathode including two side-by-side closely-spaced electron sources for providing two beams of electrons;

a first electrode having two apertures therethrough axially aligned with said two electron sources for controllably passing the two beams of electrons from said two electron sources toward the faceplate of said projection tube vacuum envelope;

a second electrode having two apertures therethrough axially aligned with the two apertures of said first electrode for forming the two beams of electrons passing therethrough from the first electrode toward the faceplate of said projection tube vacuum envelope; and a third electrode having at least one aperture therethrough of larger diameter than and axially aligned with the two apertures of said second electrode, for focusing the two beams of electrons passing therethrough from the second electrode to the faceplate of said projection tube vacuum envelope;

whereby the projection tube has a beam current that is effectively the electrons of the two electron beams.

32. The two-beam monochrome projection tube of claim 31 wherein the two beams of electrons are substantially coincident on the faceplate of said projection tube vacuum envelope.

* * * * *